United States Patent [19]

White

[11] Patent Number: 4,498,895

[45] Date of Patent: Feb. 12, 1985

[54] FOLDING PALLET JIG

[75] Inventor: Herbert V. White, Borger, Tex.

[73] Assignee: J. M. Huber Corporation, Locust, N.J.

[21] Appl. No.: 464,830

[22] Filed: Feb. 8, 1983

[51] Int. Cl.[3] ..... B21B 1/21

[52] U.S. Cl. ..... 493/476; 493/176; 493/478; 493/964; 493/162

[58] Field of Search ..... 493/89, 162, 171, 174, 493/175, 176, 168, 476, 478, 964

[56] References Cited

U.S. PATENT DOCUMENTS 3,101,653 8/1963 Borden ..... 493/168

3,236,159 2/1966 Taddeau ..... 493/162

3,975,994 8/1976 Nakane ..... 493/168

*Primary Examiner*—Francis S. Husar

*Assistant Examiner*—Jorji M. Griffin

*Attorney, Agent, or Firm*—Harold H. Flanders; August E. Roehrig, Jr.

[57] ABSTRACT

A jig construction having adjustable spacers which may be positioned to accommodate various sizes of pre-cut paperboard or cardboard sheets from which folded pallets are formed. The jig includes manually and semi-automatically actuated mechanisms for adjusting the size of the cardboard pallet formed thereon, and to facilitate bending and creasing sections of the paperboard for forming the pallet construction.

6 Claims, 13 Drawing Figures

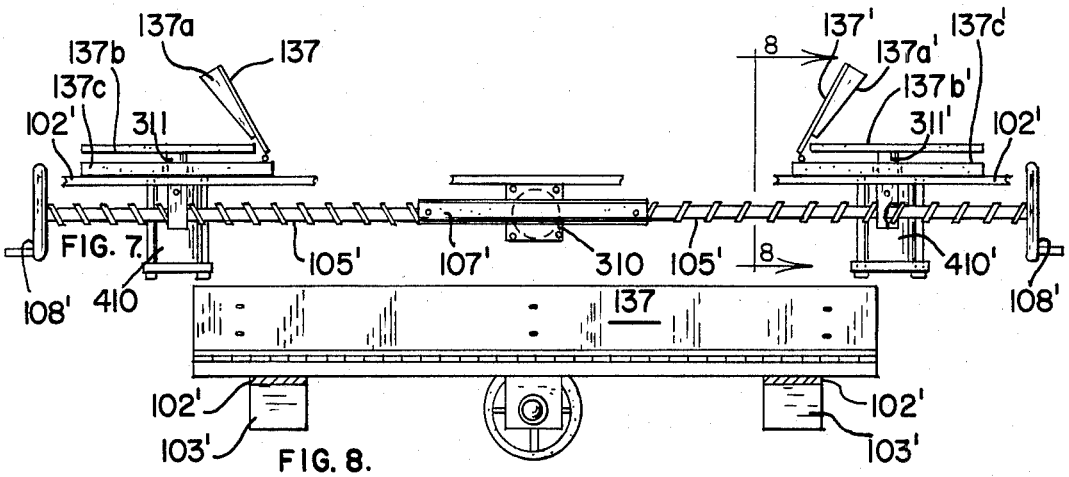
FIG. 7.
FIG. 8.
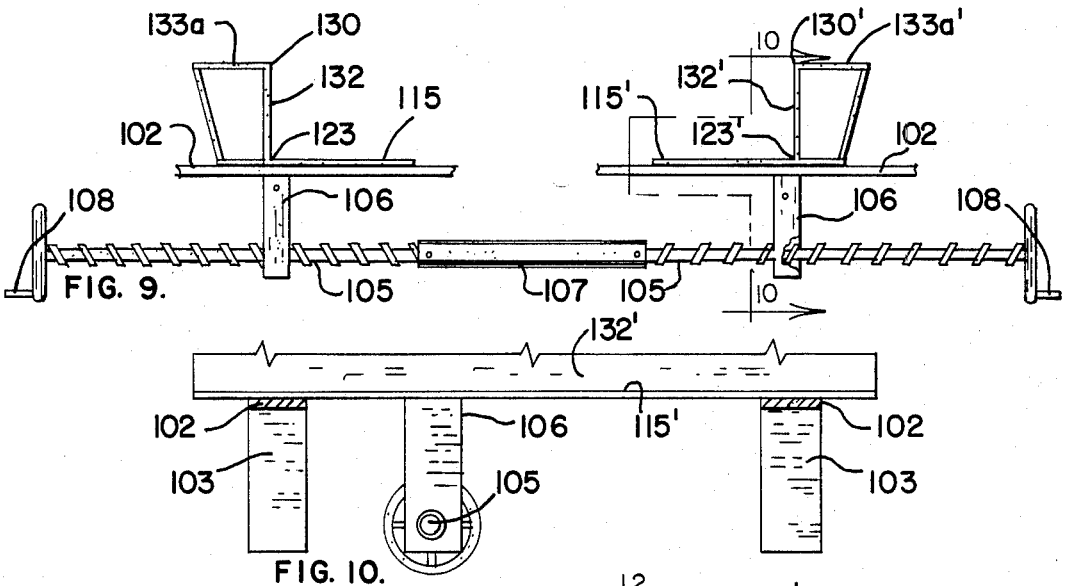
FIG. 9.
FIG. 10.
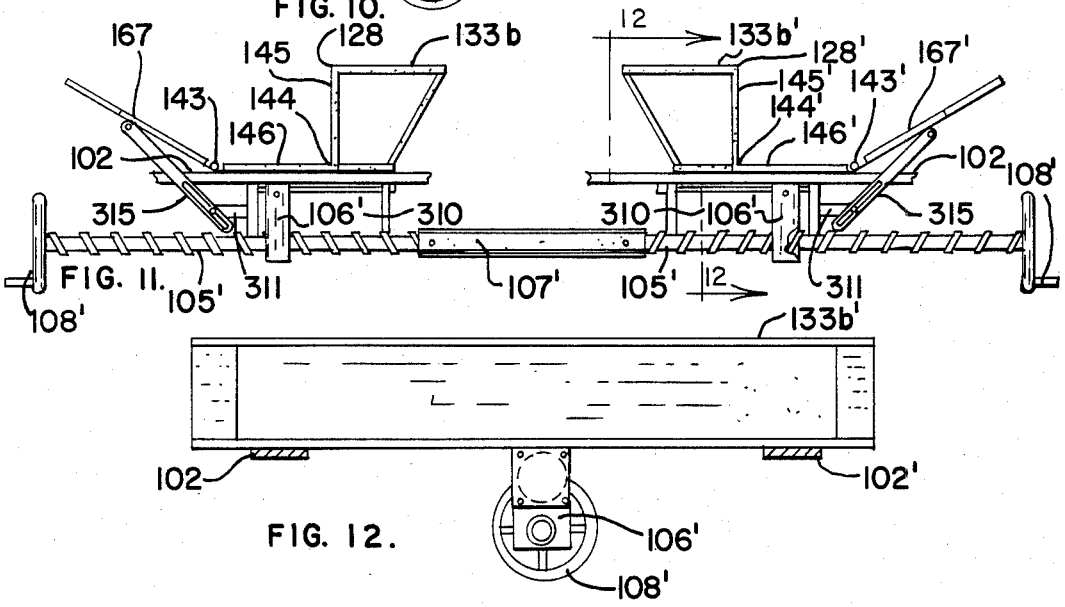
FIG. 11.
FIG. 12.

FOLDING PALLET JIG

BACKGROUND OF THE INVENTION

This invention relates in general to fixtures for constructing paperboard articles and, in particular, to a jig for folding pre-cut paperboard sheets.

More specifically, but without restriction to the particular use which is shown and described, this invention relates to a jig for use in fabricating a sheet of pre-cut paperboard or cardboard, of suitable weight or gauge, which is constructed into a pallet utilized for storing and transporting quantities of packaged materials so that the materials can be conveniently handled by a fork-lift truck.

In order to conveniently transport and store certain materials, such as those which are contained in bags or boxes, it is generally most convenient to store such materials on a pallet. These pallets are usually constructed of wood, but are sometimes formed from paperboard or cardboard blanks to produce a less expensive pallet, or one which may be economically disposed of when it has completed its function. However, pallets constructed from cardboard or paperboard are generally limited in their use because they do not have enough rigidity for many applications, and are time consuming in their fabrication. However, one such folded pallet construction which has been found quite suitable for use in palletizing bagged or boxed materials is described in the present inventor's U.S. Pat. No. 4,372,221, entitled "Folding Pallet", the disclosure of which is hereby incorporated by reference. The apparatus of the present invention may be utilized, for example, in facilitating fabrication of the folding pallets described in the afore-mentioned U.S. patent, and to that end is constructed for fabricating various sizes of pallet constructions.

SUMMARY OF THE INVENTION

It is, therefore, an object of this invention to improve the fabrication of paperboard or cardboard pallets.

Another object of this invention is to facilitate construction of cardboard or paperboard pallets utilized for storing and transporting quantities of material contained in bags or boxes.

A further object of this invention is to construct folded pallets formed from various sizes of pre-cut cardboard or paperboard sheets.

These and other objects are attained in accordance with the present invention wherein there is provided a jig construction having adjustable spacers which may be positioned to accommodate various sizes of pre-cut paperboard or cardboard sheets from which folded pallets are formed. The jig includes manually amd semi-automatically actuated mechanisms for adjusting the size of the cardboard pallet formed thereon, and to facilitate bending and creasing sections of the paperboard board for forming the pallet construction.

DESCRIPTION OF THE DRAWINGS

Further objects of the invention, together with additional features contributing thereto and advantages accruing therefrom will be apparent from the following description of a preferred embodiment of the invention, which is shown in the accompanying drawings, with like reference numerals indicating corresponding parts throughout, wherein:

FIG. 7 is a view of an enlarged portion of the jig construction to show the manner in which portions thereof are adjustable;

FIG. 8 is a view of a portion of the jig construction of FIG. 7 taken along lines 8—8;

FIG. 9 is another enlarged view of a portion of the jig construction to better illustrate the manner in which internal spacer portions thereof are adjustable;

FIG. 10 is a view of the apparatus shown in FIG. 9 taken along lines 10—10;

FIG. 11 is another enlarged view of a portion of the jig construction to better illustrate the manner in which external spacer portions thereof are adjustable;

FIG. 12 is a view of the apparatus shown in FIG. 11 taken along lines 12—12.

DESCRIPTION OF THE PREFERRED EMBODIMENT

Figure 1:
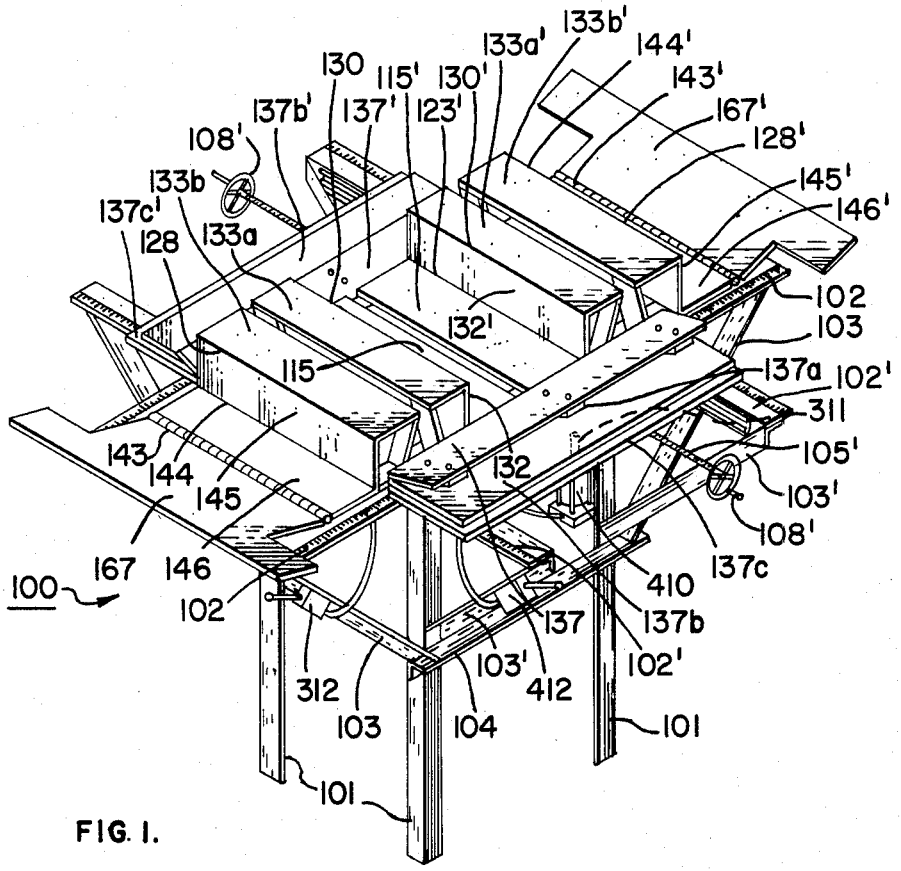
FIG. 1 is a frontal perspective view of a folding jig constructed in accordance with the invention.
Figure 2:
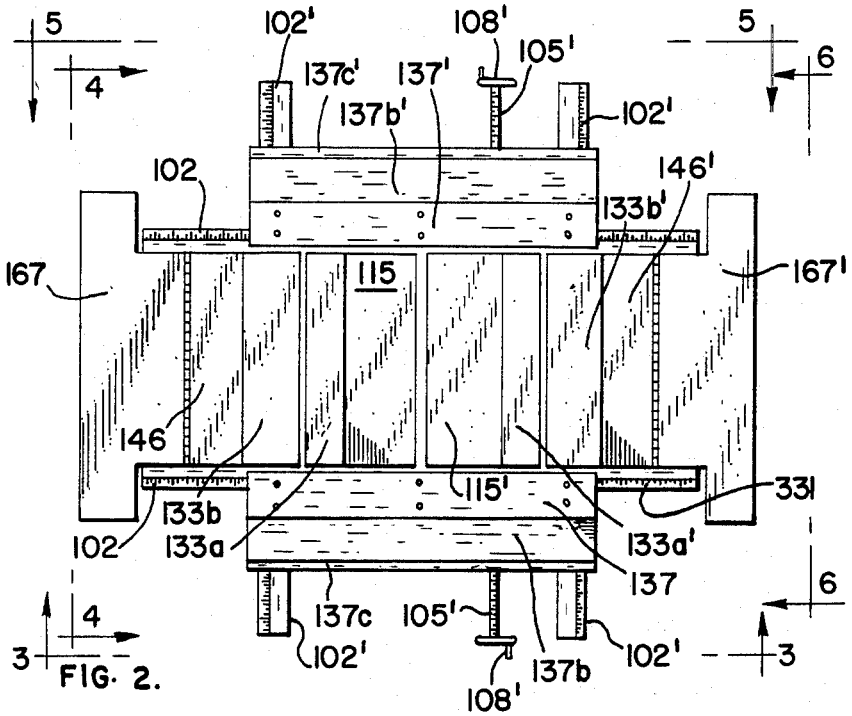
FIG. 2 is a top elevational view of the jig shown in FIG. 1.
Figure 3:
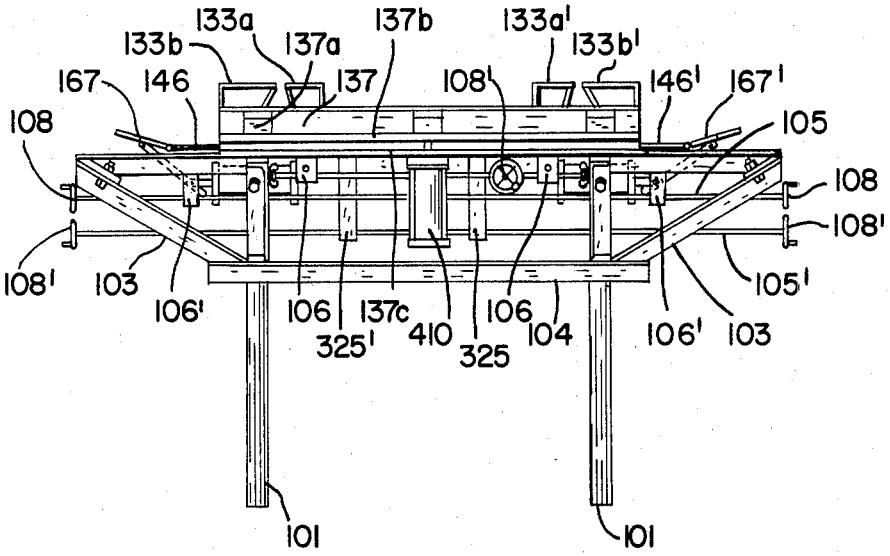
FIG. 3 is a frontal view of the jig taken along lines 3—3 of FIG. 2.
Figure 4:
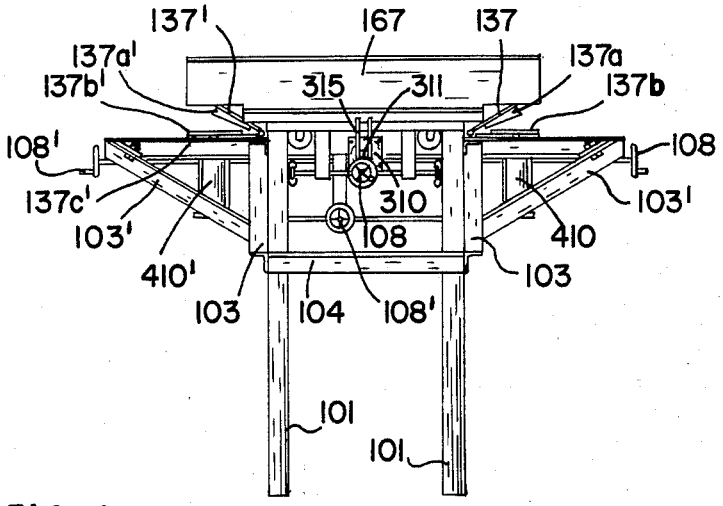
FIG. 4 is a side view of the jig shown in FIG. 2 taken along lines 4—4.
Figure 5:
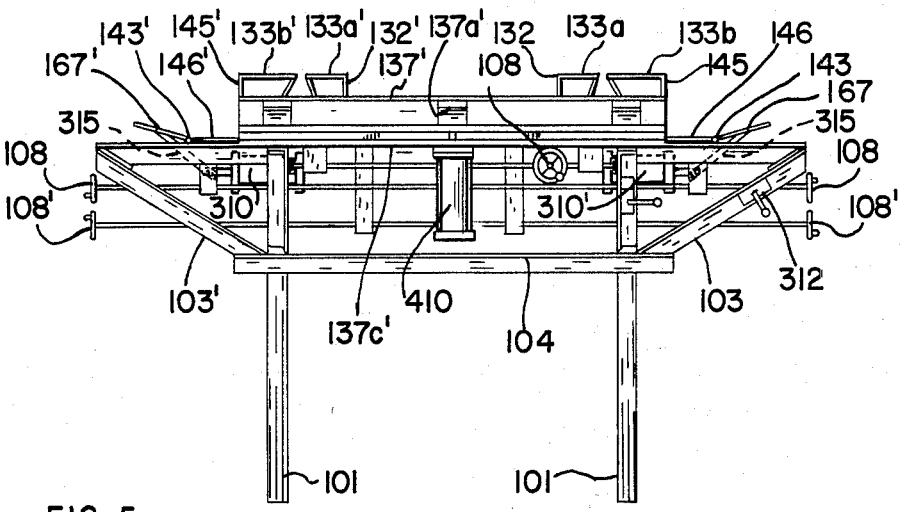
FIG. 5 is a rear view of the jig shown in FIG. 2 taken along lines 5—5.
Figure 6:
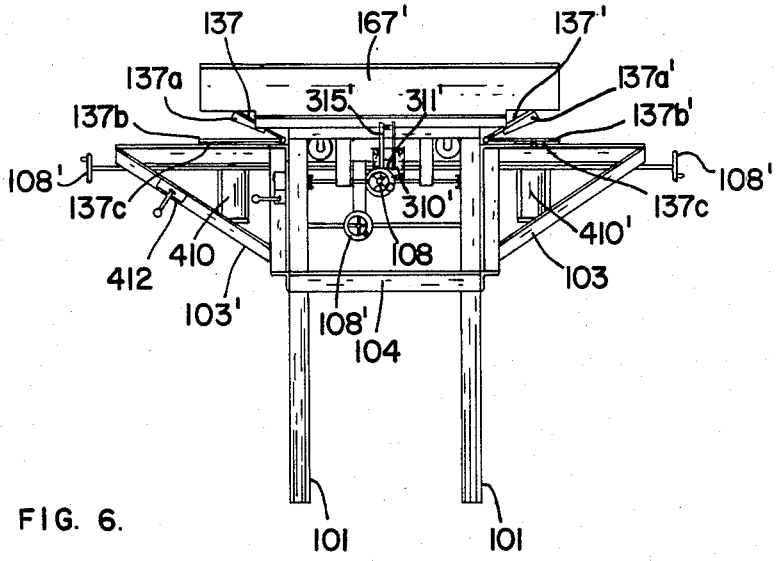
FIG. 6 is a side view of the jig shown in FIG. 2 taken in the direction of lines 6—6.

Referring now to FIG. 1, the folding jig 100 is carried on a plurality of legs 101 to elevate the folding portions thereof to a convenient height, so that an operator may readily place sheets of pre-cut paperboard or cardboard material on top of the jig to be folded into pallets. Throughout this description, the terms paperboard and cardboard are used interchangeably with reference to the material from which these folded pallets are formed.

The folding jig includes two pairs of adjustable spacers, each comprising an inner and outer spacer 133*a*, 133*b* and 133*a'* and 133*b'* with one pair of spacers being positioned at either side of a central cavity forming portion of the jig. For convenience of illustration, certain pallet forming portions of the jig are identified by reference numerals which correspond to portions of the pallet which are formed thereon, and described in the afore-referenced patent, by adding 100 to the numerals used in identifying elements of the pallet to indicate portions of the jig which are used in contacting or forming these elements of the pallet. Since portions of the jig 100 are constructed symmetrically with respect to opposing sides, for further convenience of illustration only one side may be described in detail, with the same reference numeral having a prime designation being used to indicate the same construction being used on the opposite side, or for additional components of the same construction.

The distance between the inner and outer spacers 133*a*, 133*b* and 133*a'*, 133*b'*, of each spacer pair, may be varied to correspondingly vary the size of a flat or land portion of a paperboard pallet formed thereon in a manner to be hereinafter described in detail. In addition, the lateral distance between the two pairs of spacers 133*a*, 133*b* and 133*a'*, 133*b'* may also be varied, in a manner to be hereinafter described in detail, to correspondingly vary the size of the central cavity forming portion of a paperboard pallet constructed thereon.

In operation, a pre-cut sheet of cardboard, which for convenience of erection may also be pre-creased, is laid horizontally on top of the pairs of spacers 133*a*, 133*b* and 133*a'*, 133*b'*, and folded downwardly over an inner edge 130, 130' of the inner spacer 133*a*, 133*a'* along a vertical side wall 132, 132' of the inner spacer, to a horizontally extending bottom wall forming portion 115, 115' of the inner spacer. These elements function to form the pallet into having a central cavity portion. The outwardly extending portion of the cardboard sheet lying on top of the pair of spacers 133*a*, 133*b* and 133*a'*, 133*b'* is subsequently, as hereinafter described, bent downwardly about an outer edge 128, 128' of the outer spacer 133*b*, 133*b'*, along a vertical side wall 145, 145' thereof to extend horizontally outwardly therefrom across a bottom wall forming portion 146, 146' of the outer spacer after being folded at the Joinder line 144, 144' between these two surfaces. The paperboard extends across the surface of an end plate 167, 167' of the jig, which is hingedly attached at 143, 143' to the terminal portion of the bottom wall forming plate 146, 146' of the outer spacer 133*b*, 133*b'*. The end plate 167, 167' is somewhat T-shaped to correspond to a portion of the pre-cut cardboard, and is pivotal upwardly about the hinged connection 143, 143' with the bottom wall forming portion 146, 146' of the outer spacer to fold the cardboard sheet lying adjacent thereto into a position substantially perpendicular to the bottom wall forming portion 145, 145', thereby forming two end walls of the pallet.

In order to erect pallets having portions of different component dimensions, both the inner spacers 133*a*, 133*a'* and the outer spacers 133*b*, 133*b'* are movable to form various size internal elements of the pallets. As best shown in FIGS. 9 and 10, the inner spacers 133, 133*a'* are each slidably supported for lateral movement on a pair of slide rails or runners 102 which have the outer ends thereof connected to braces 103 which extend outwardly from cross braces 104 carried between pairs of the legs 101. To facilitate positioning of the spacers, slide rails 102 have marking indicia formed thereon. Movement of the inner spacers 133*a* and 133*a'* is effected by rotation of a lead screw 105 which is connected to each spacer through a carriage bracket 106, having a suitable bushing or bearing supported therein, such that rotational movement of the lead screw 105 will effect lateral movement of the inner spacers 133*a*, 133*a'*.

The lead screw 105 is formed with two portions having reversed thread configurations, joined by a union 107, such that rotational movement of the lead screw 105 by means of a handle 108, secured at each end, will effect equidistant movement of the inner spacers 133*a*, 133*a'* toward or away from each other in accordance with the direction in which the lead screw is rotated. By rotating the handle 108, the lateral distance between the two vertical side walls 132, 132' will be varied to correspondingly change the width of the central cavity forming portion of the jig and, thereby, a pallet formed thereon.

FIGS. 11 and 12 illustrate the manner in which the outer spacers 133*b* and 133*b'* are movable laterally toward and away from each other to vary the distance between the two folding edges 128 and 130 of one pair of spacers and, correspondingly, 128' and 130' of the other spacer pair. To this end the outer spacers 133*b*, 133*b'* are also carried by the pair of runners or slide rails 102 at each end of the spacers, which function to support the movement of the spacer in a horizontal plane. A carriage bracket 106', having a suitable bushing or bearing carried therein as with the bracket 106, is engaged by a lead screw 105' similar to the lead screw 105. A union 107' joins the two portions of the lead screw 105', which are threaded in opposite directions, such that rotational movement of the lead screw by operation of a handle 108', cause the spacers 133*b*, 133*b'* to move toward or away from each other an equal linear distance. As previously described, the slide or guide rails 102 are formed with a series of graduations or marking indicia thereon, to facilitate movement of the spacers 133*b*, 133*b'* to a predetermined position for erection of the folding pallet.

A pair of hydraulically actuated cylinders 310, 310' are secured to the underside of each of the bottom wall forming plate portions 146, 146' of each outer spacer. The cylinders 310, 310' have their cylinder plungers 311, 311' connected through a slider bar mechanism 315, 315' so that extension of the plungers 311, 311' upon actuation of these cylinders, will effect a rotational movement of the end plates 167, 167' about their respective hinges 143, 143'. Actuation of the hydraulic cylinders 310, 310' is controlled by a suitable switch 312 carried by a portion of the jig frame such as braces 103'.

As the spacer pairs 133*a*, 133*b* and 133*a'*, 133*b'* are movable in a first direction, to accommodate the formation of various sizes of pallets, the jig 100 is also adapted to have other portions thereof movable in a direction transverse of the movement of the spacer pairs. To this end a mechanism which is utilized to fold the side walls of a pallet being erected thereon is shown in enlarged detail in FIGS. 7 and 8. The side wall folding mechanism 137, 137*a*, 137*b*, 137*c*, and 137', 137*a'*, 137*b'*, 137*c'*, are each slidably supported for lateral movement in a direction transverse to the movement of the spacer pairs, on a pair of slide rails or runners 102' which have the outer ends thereof connected to braces 103' which extend outwardly from cross braces 104 carried between pairs of the legs 101. As with the slide rails 102, the slide rails 102' have marking indicia formed thereon to facilitate positioning of the side wall folding mechanism.

Movement of the side wall forming mechanism 137–137*c* and 137'–137*c'* is effected by rotation of a lead screw 105' which is connected to each side folding mechanism through a carriage bracket 106', having a suitable bushing or bearing carried therein, which is engaged by a lead screw 105' similar to the manner of the lead screw and carriage brackets 105 and 106, respectively. A union 107' joins two portions of the lead screw 105' which are threaded in opposite direction such that rotational movement of a handle 108' secured at each end of the lead screw causes the rotational movement of the lead screw to be translated into equidistant linear movement of the two folding mechanisms 137–137*c* and 137'–137*c'* toward or away from each other in equal amounts.

In erecting a folding pallet from a sheet of paperboard, first the paperboard is placed on top of the jig, and the paperboard folded about the inner spacers 133*a*, 133*a'* and the central cavity portion of the pallet is formed thereby. Then, before the outwardly extending portion of the paperboard lying on top of the spacers and extending outwardly therefrom, is folded downwardly about the outer spacers 133*b*, 133*b'* to form the end walls of the pallet, the side walls of the pallet are formed by operation of the side wall forming mechanism 137–137*c*′ and 137′–137*c*′.

To effect formation or erection of the pallet side walls, side wall forming plates 137 and 137′ are each respectively pivotally connected to base plates 137*c* and 137*c*′ by a suitable hinge connection extending the width of the respective plates. The side wall forming plates 137, 137′, are each connected to the inner portion of their respective base plates 137*c*, 137*c*′. Beneath the lower surface of each of the mounting plates 137, 137*c*′, a hydraulic cylinder 410, 410′ is secured thereto, having a plunger 411, 411′ which extends upwardly from the cylinder casing through an aperture formed in each of the mounting plates 137*c*, 137*c*′. The upper or free end of each of the cylinder plungers 411, 411′ is connected to a pressure plate 137*b*, 137*b*′ which is moved upwardly upon actuation of the cylinders 410, 410′. A plurality of wedge-shaped cam plates 137*a*, 137*a*′ are secured to the inner surface of the side wall forming plates 137, 137′ and are engaged by the upward movement of the pressure plate 137*b*, 137*b*′ to rotate the side wall forming plates 137, 137′ about their pivotal hinged connection to the mounting plates 137*c*, 137*c*′.

In this manner, upon actuation of a switch 412, carried on a portion of the jig frame, the hydraulic cylinders 410, 410′ are actuated and the plungers thereof 411, 411′ will be extended upwardly through the aperture formed in the mounting plate 137*c*, 137*c*′. The pressure plates 137*b*, 137*b*′, to which the plungers are connected, will engage the wedge-shaped cam plates 137*a*, 137*a*′ secured to the side wall forming plates 137, 137′, causing these plates to rotate inwardly about their respective hinged connections thereby folding the paperboard sheet for forming a side wall. At the same time, or subsequently thereto while the plunger is extended, additional manual folding operations may be performed on the paperboard sheet to effect further folding for the formation of the pallet constructed thereon.

Figure 13:
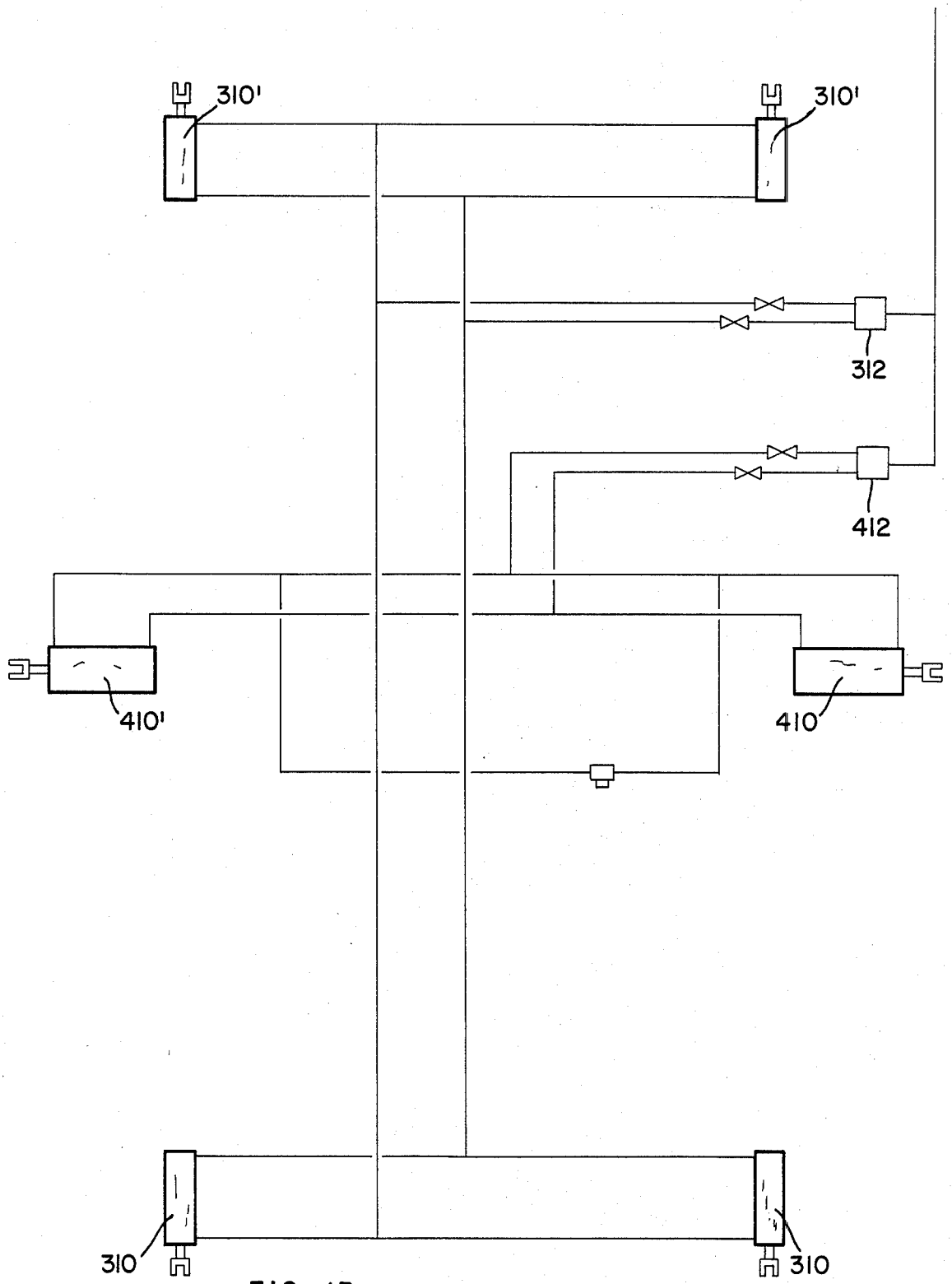
FIG. 13 is a fluid circuit schematic of various hydraulic cylinders utilized in actuating portions of the jig.

After the side wall forming plates 137, 137′ have performed their function, the paperboard is bent downwardly about the outer spacers 133*b*, 133*b*′ and the pair of hydraulic cylinders 310, 310′ operatively coupled to each end plate 167, 167′ are actuated to effect rotational movement of the respective end plates about their hinged connection 143, 143′ to fold the paperboard sheet inwardly to create an end wall formation for the paperboard pallet. FIG. 13 shows the manner in which the hydraulic cylinders 310, 310′, 410, 410′ may be suitably connected and actuated by the switches 312, 412 to effect the folding operations.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An apparatus for erecting paperboard pallets from paperboard sheets comprising a first pair and a second pair of spacers about which paperboard may be folded in forming a pallet, said spacer pairs positioned in opposed spaced relation and defining a cavity-forming recess by the space therebetween which may be utilized to form a cavity in a pallet erected thereon, each of said first and second pairs of spacers comprising an inner spacer adjacent to and defining limits of the cavity-forming recess therebetween, and an outer spacer having a horizontal planar surface which in combination with a horizontal planar surface of said inner spacer defines a land-forming portion about which paperboard may be folded in forming a pallet, means for moving said inner spacer of said first spacer pair and said inner spacer of said second spacer pair toward or away from each other to vary the size of the cavity-forming recess defined therebetween, means for moving said outer spacer of said first spacer pair and said outer spacer of said second spacer pair toward or away from each other to vary the size of the land-forming portion defined by the horizontal planar surfaces of said inner spacers and said outer spacers, each of said outer spacers having an end-plate portion hingedly connected thereto for pivotal movement about the hinged connection toward said outer spacer to which said end-plate is hingedly connected, sidewall-forming plates positioned in opposed spaced relation adjacent to said first and second pairs of spacers, with said first and second pairs of spacers extending therebetween, each of said sidewall-forming plates being hingedly supported for pivotal movement toward said first and second pairs of spacers positioned therebetween for folding paperboard in forming a pallet, and means for moving said sidewall-forming plates toward or away from each other in a direction transverse to the movement of said pairs of spacers positioned therebetween.

2. The apparatus of claim 1 wherein each of said means for moving said inner spacers of said first and said spacer pairs toward or away from each other, said means for moving said outer spacer of said first and second spacer pairs toward or away from each other, and said means for moving said sidewall-forming plates toward or away from each other all comprise a lead screw having two portions with oppositely directed threads formed thereon to effect said movement of said respective inner spacers, outer spacers, and said sidewall-forming plates upon rotational movement of said lead screws.

3. The apparatus of claim 1 further including a hydraulic cylinder supported from a portion of said outer spacers and having an outwardly extendable cylinder plunger extendable therefrom upon the actuation of the cylinder, and each of said end-plate portions having engaging means coupled thereto for connecting to said cylinder plunger such that upon actuation of said cylinder the movement of said cylinder plunger will pivot said end plates about the hinge connection toward said outer spacer to which said end-plate is hingedly connected.

4. The apparatus of claim 1 further including a support plate upon which said sidewall-forming plates are hingedly supported for pivotal movement and having an aperture formed therein, a hydraulic cylinder supported from said support plate and having an outwardly extendable cylinder plunger extendable through said aperture formed in said support plate upon actuation of the cylinder, a pressure plate carried by an end of said cylinder plunger for movement therewith, and wedge-shaped cam means carried by said sidewall-forming plates and positioned to be engaged by said pressure plate upon the actuation of said cylinder for pivotally moving said sidewall-forming plates about the hinged connection to said support plates.

5. The apparatus of claim 1 further including means for pivotally moving said end-plate portions of each of said outer spacers about said hinged connection therewith.

6. The apparatus of claim 1 further including means for pivotally moving each of said sidewall-forming plates about said hinged connection.

* * * * *